US011540620B2

(12) United States Patent
Chen

(10) Patent No.: US 11,540,620 B2
(45) Date of Patent: Jan. 3, 2023

(54) HAIR COMB WITH REPLACEABLE DECORATIVE COVER

(71) Applicant: ZHONGSHAN YINGLIANG HEALTH TECHNOLOGY CO., LTD., Zhongshan (CN)

(72) Inventor: Yi-Tzu Chen, Taoyuan (TW)

(73) Assignee: Zhongshan Yingliang Health Technology Co., Ltd., Zhongshan (CN)

( * ) Notice: Subject to any disclaimer, the term of this patent is extended or adjusted under 35 U.S.C. 154(b) by 209 days.

(21) Appl. No.: 17/108,312

(22) Filed: Dec. 1, 2020

(65) Prior Publication Data

US 2022/0167737 A1 Jun. 2, 2022

(51) Int. Cl.

| | |
|---|---|
| ***A46B 5/02*** | (2006.01) |
| ***A46B 15/00*** | (2006.01) |
| ***A46B 9/02*** | (2006.01) |
| ***A46B 17/06*** | (2006.01) |

(52) U.S. Cl.

CPC ..... *A46B 15/0087* (2013.01); *A46B 5/02* (2013.01); *A46B 9/023* (2013.01); *A46B 17/06* (2013.01); *A46B 2200/104* (2013.01)

(58) Field of Classification Search

CPC ..... A46B 15/0087; A46B 17/06; A46B 9/023

See application file for complete search history.

(56) References Cited

U.S. PATENT DOCUMENTS

| | | | | |
|---|---|---|---|---|
| 168,428 A | | 10/1875 | Teets | |
| 497,451 A | | 5/1893 | Kintner | |
| 3,634,178 A | | 1/1972 | Goodman | |
| 5,320,125 A | * | 6/1994 | Barnhart | A45D 40/18 132/297 |
| 2020/0359762 A1 | * | 11/2020 | Chang | A45D 8/20 |

FOREIGN PATENT DOCUMENTS

| | | | |
|---|---|---|---|
| JP | 3219054 U | 11/2018 | |
| KR | 20210037852 A | 4/2021 | |

* cited by examiner

*Primary Examiner* — Michael D Jennings

(74) *Attorney, Agent, or Firm* — Rosenberg, Klein & Lee

(57) ABSTRACT

A hair comb is provided and comprises a base assembly, a comb teeth assembly, and a cover unit. The base assembly comprises a first surface and a second surface opposite to each other. The comb teeth assembly is placed at the first surface of the base assembly. The cover unit is detachably mounted on the second surface. The cover unit comprises a third surface and a fourth surface opposite to each other. The third surface faces the second surface and the fourth surface is decorated by decorative patterns or figures.

8 Claims, 12 Drawing Sheets

HAIR COMB WITH REPLACEABLE DECORATIVE COVER

BACKGROUND OF THE INVENTION

1. Field of the Invention

The present invention relates to a hair comb, especially to a hair comb that is able to replace a cover with different figures and decorations.

2. Description of the Prior Arts

It is human nature to look attractive, so people not only have a high standard for their appearances, but also choose any accessory that matches the outfit. Especially the styles of female apparel are highly variable and can be expressed in many different ways, which makes the preparation of corresponding accessories to match the overall style an uneasy task. For instance, a hair comb is always stored in every lady's makeup bag and has its own decoration and style. However, the hair comb cannot fit different styles due to the single decoration, and preparing multiple stylish hair combs would be impractical.

On the other hand, currently the way to manufacture a hair comb is to have the decorations mounted on the hair comb's body itself, which makes it harder to replace the decorations to satisfy consumers' various needs in styling and fashion. If the manufacturer offers a large number of hair combs in different styles to meet the consumers' demands, it would pose a tremendous burden on manufacture and warehouse management.

To overcome the shortcomings, the present invention provides a hair comb with a replaceable decorative cover to mitigate or obviate the aforementioned problems.

SUMMARY OF THE INVENTION

The main objective of the present invention is to provide a hair comb with a replaceable decorative cover that allows a user to easily change the decorative cover of the hair comb and thus makes the hair comb adaptable to their outfits.

The hair comb has a base assembly, a magnet component, a comb teeth assembly, a cover unit, and a magnet-attracted component. The base assembly comprises a first surface and a second surface opposite to each other. The magnet component is mounted on the second surface of the base assembly. The comb teeth assembly is mounted on the first surface of the base assembly. The cover unit is detachably mounted on the second surface. The cover unit comprises a third surface and a fourth surface opposite to each other. The third surface faces the second surface and the fourth surface is decorated by patterns or figures. The magnet-attracted component is located at the cover unit and is capable of being attracted by the magnet component.

Another hair comb has a base assembly, a magnet component, a comb teeth assembly, and a cover unit. The base assembly comprises a first surface and a second surface opposite to each other. The magnet component is mounted on the second surface of the base assembly. The comb teeth assembly is mounted on the first surface of the base assembly. The cover unit is detachably mounted on the second surface and is made from a magnetic material so that the cover unit is capable of being attracted by the magnet component. The cover unit comprises a third surface and a fourth surface opposite to each other. The third surface faces the second surface and the fourth surface is decorated by patterns or figures.

With the detachable cover unit and the magnet component, the hair comb allows a user to change the cover unit. For manufactures, to manufacture hair combs in different styles only requires producing the comb bodies of the same specifications (the base assembly and the comb teeth assembly) and various decorative covers with different patterns or figures. Therefore, this not only reduces the cost of manufacture and storage but also satisfies the consumers' need for variable styles. Moreover, it allows the consumers to have multiple cover units and replace the cover units by themselves so that the hair comb may be adapted to their outfits.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
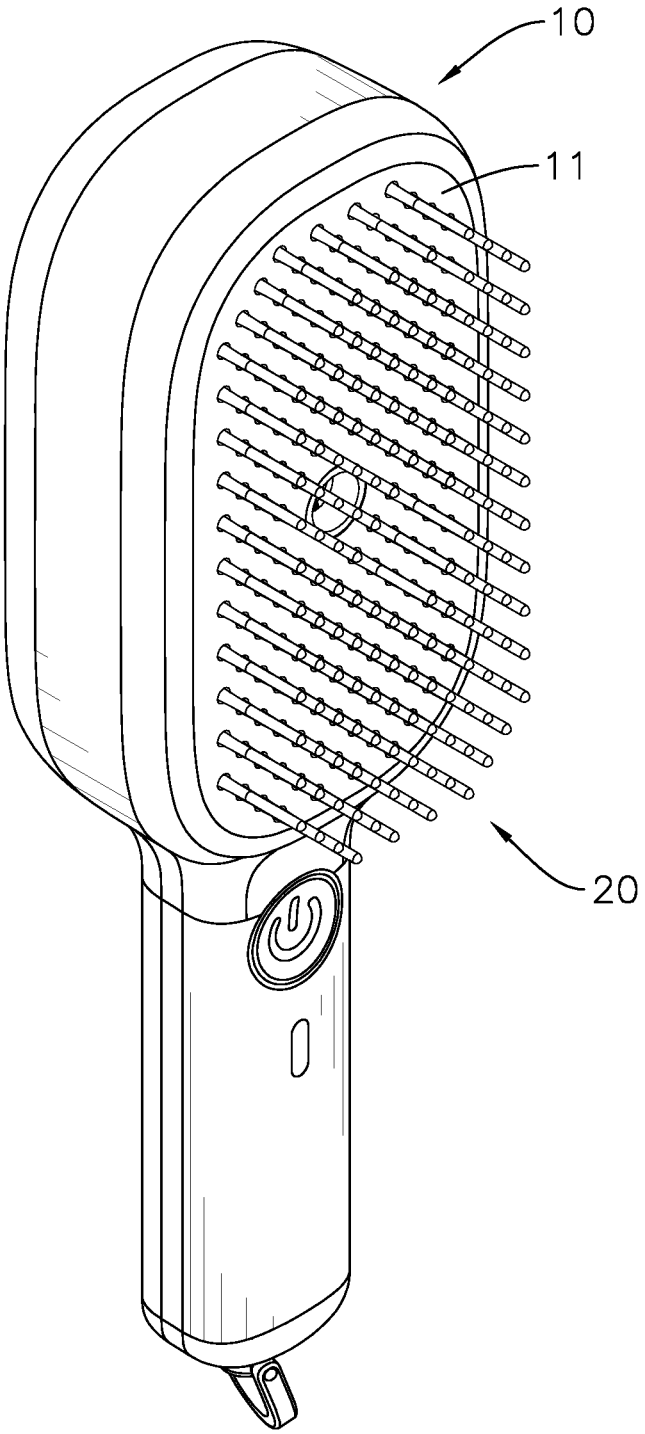
FIG. 1 is a perspective view of a hair comb with a replaceable decorative cover in accordance with a first embodiment of the present invention, showing a comb teeth assembly extending out.

With reference to FIG. 1 to FIG. 4, a hair comb with a replaceable decorative cover in accordance with the present invention is provided. Users are able to replace a cover unit of the comb, which gives the hair comb different visual appeals. In a first embodiment of the present invention, the hair comb comprises a base assembly 10, a comb teeth assembly 20, and a cover unit 30, and selectively comprises a handle. The base assembly 10 comprises a first surface 11 and a second surface 12 opposite to each other. The comb teeth assembly 20 is mounted on the first surface 11 of the base assembly 10. In this embodiment, the comb teeth assembly 20 is capable of being retracted back into the first surface 11 of the base assembly 10 in order to avoid damaging the comb teeth assembly 20 during transport. In other embodiments, the comb teeth assembly 20 can be fixed with respect to the base assembly 10, and therefore the comb teeth assembly 20 would not be retractable back into the base assembly 10. The cover unit 30 is detachably mounted on the second surface 12 of the base assembly 10. The cover unit 30 comprises a third surface 301 and a fourth surface 302 opposite to each other. The third surface 301 faces the second surface 12, and the fourth surface 302 has a decorative pattern or figure A thereon.

Figure 5:
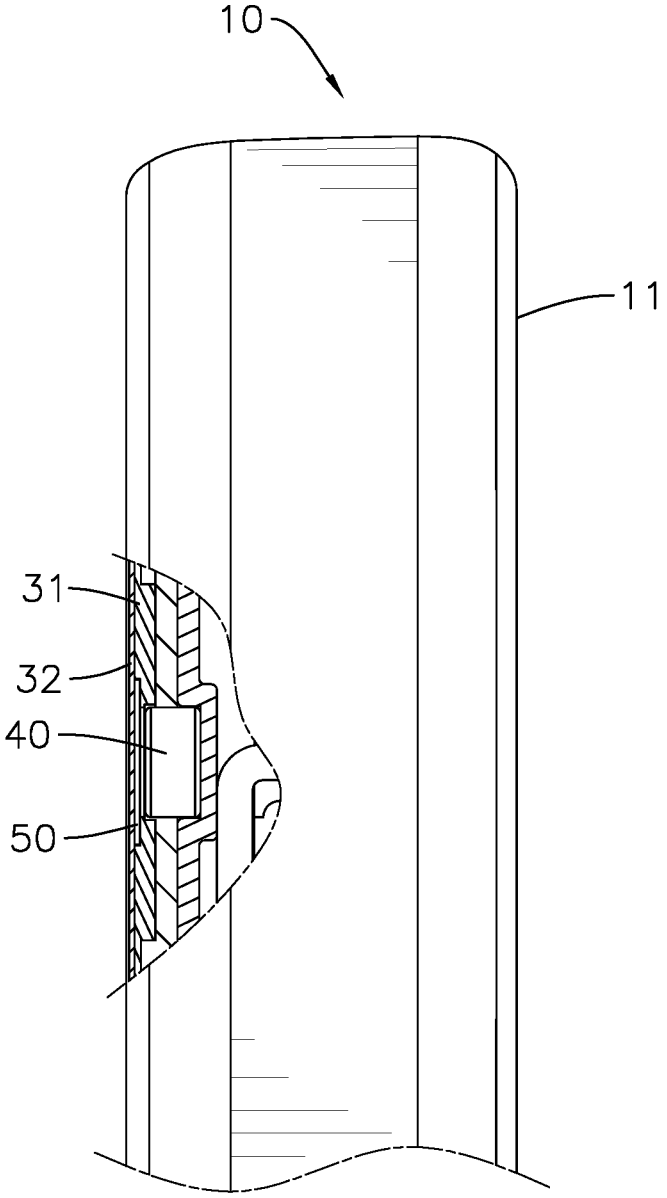
FIG. 5 is a partial sectional view of the hair comb in FIG. 3.

Then please refer to FIG. 5. In the first embodiment, the cover unit 30 can be attracted by the base assembly 10 because of magnetic force. Specifically, the hair comb comprises a magnet component 40 and a magnet-attracted component 50, and the magnet component 40 is configured to attract the magnet-attracted component 50. The magnet component 40 includes, but not limited to, materials that actively emit the magnetic force, such as a magnet. The magnet-attracted component 50 includes, but not limited to, metallic materials which can be attracted by the magnet component 40. The magnet-attracted component 50 may include magnet. In this embodiment, the magnet component 40 is mounted on the second surface 12 of the base assembly 10, and the magnet-attracted component 50 is mounted on the cover unit 30. Therefore, the cover unit 30 is detachably mounted on the base assembly 10.

Further, the cover unit 30 comprises a foundation plate 31 and a decoration layer 32. The foundation plate 31 is detachably mounted on the second surface 12, and the third surface 301 is formed on the foundation plate 31. The decoration layer 32 is mounted on the foundation plate 31, and the fourth surface 302 is formed on the decoration layer 32. The magnet-attracted component 50 is mounted between the foundation plate 31 and the decoration layer 32.

In this embodiment, the magnet attraction component 40 protrudes out of the second surface 12. The foundation plate 31 of the cover unit 30 has a recess 303 which allows the magnet component 40 to fit therein, to prevent the cover unit 30 from moving when the cover unit 30 is mounted on the base assembly 10.

Figure 2:
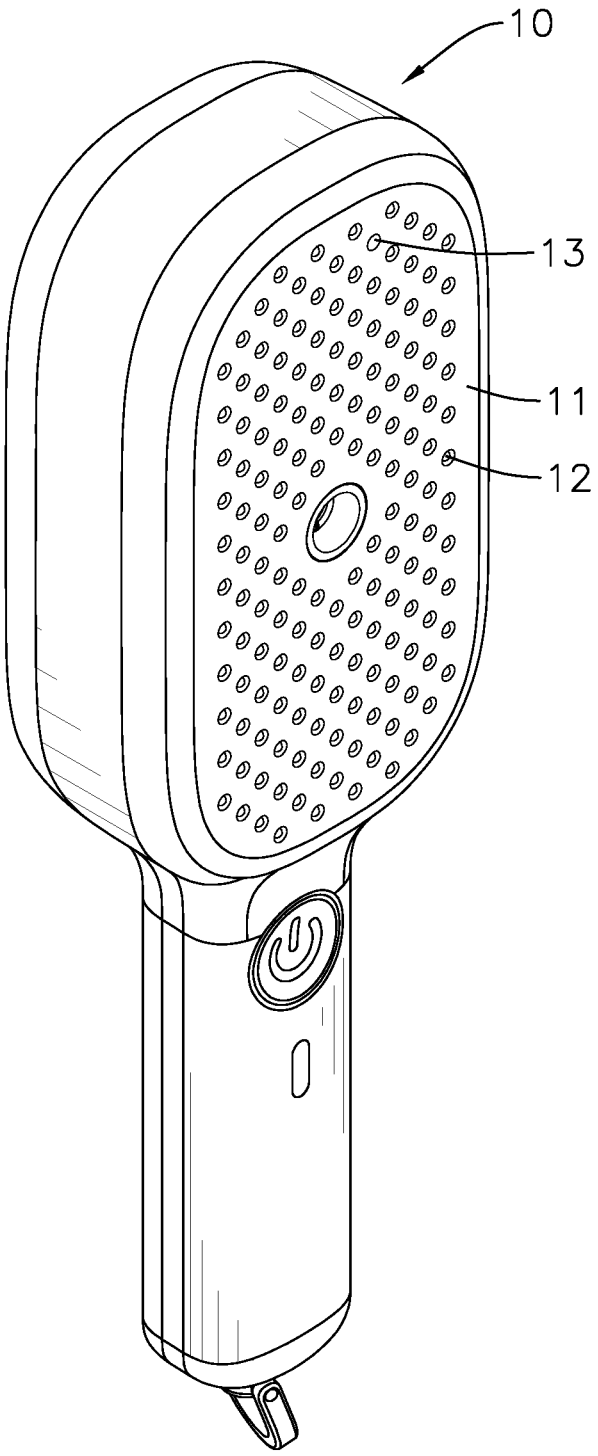
FIG. 2 is a perspective view of the hair comb in FIG. 1, showing the comb teeth assembly retracted.
Figure 3:
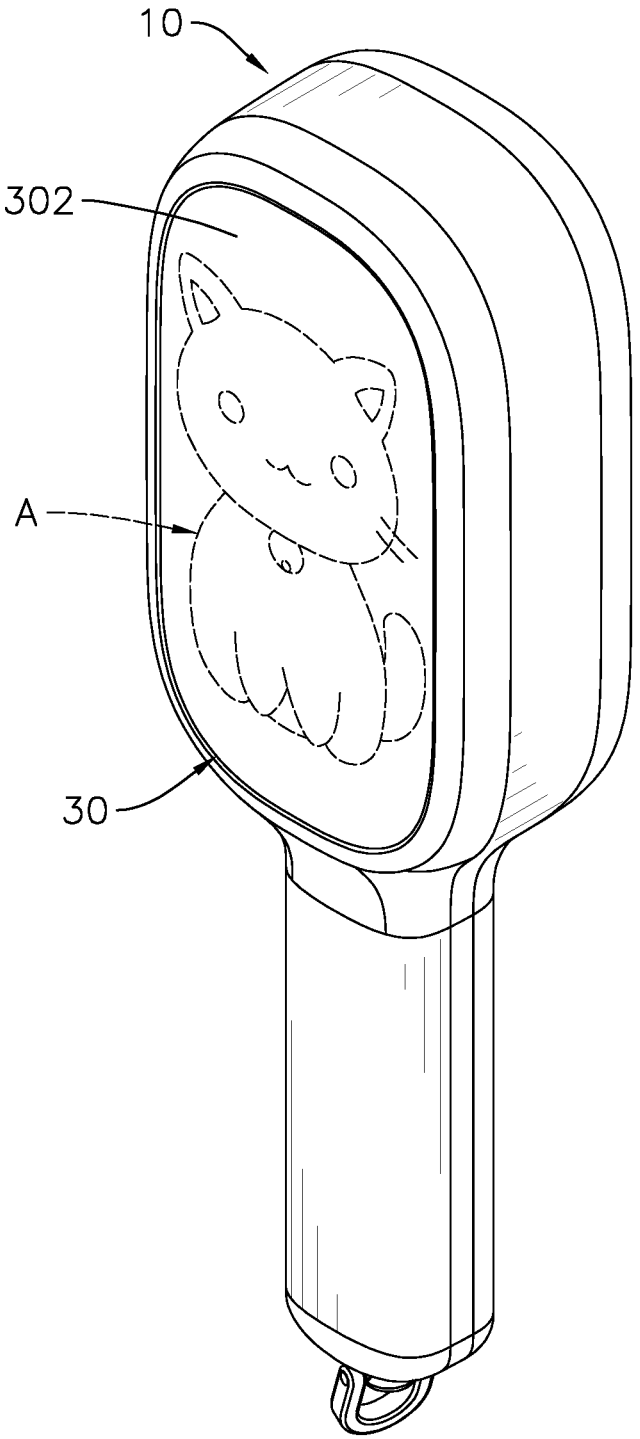
FIG. 3 is another perspective view of the hair comb in FIG. 1, showing a pattern or figure on a fourth surface of the hair comb.
Figure 4:
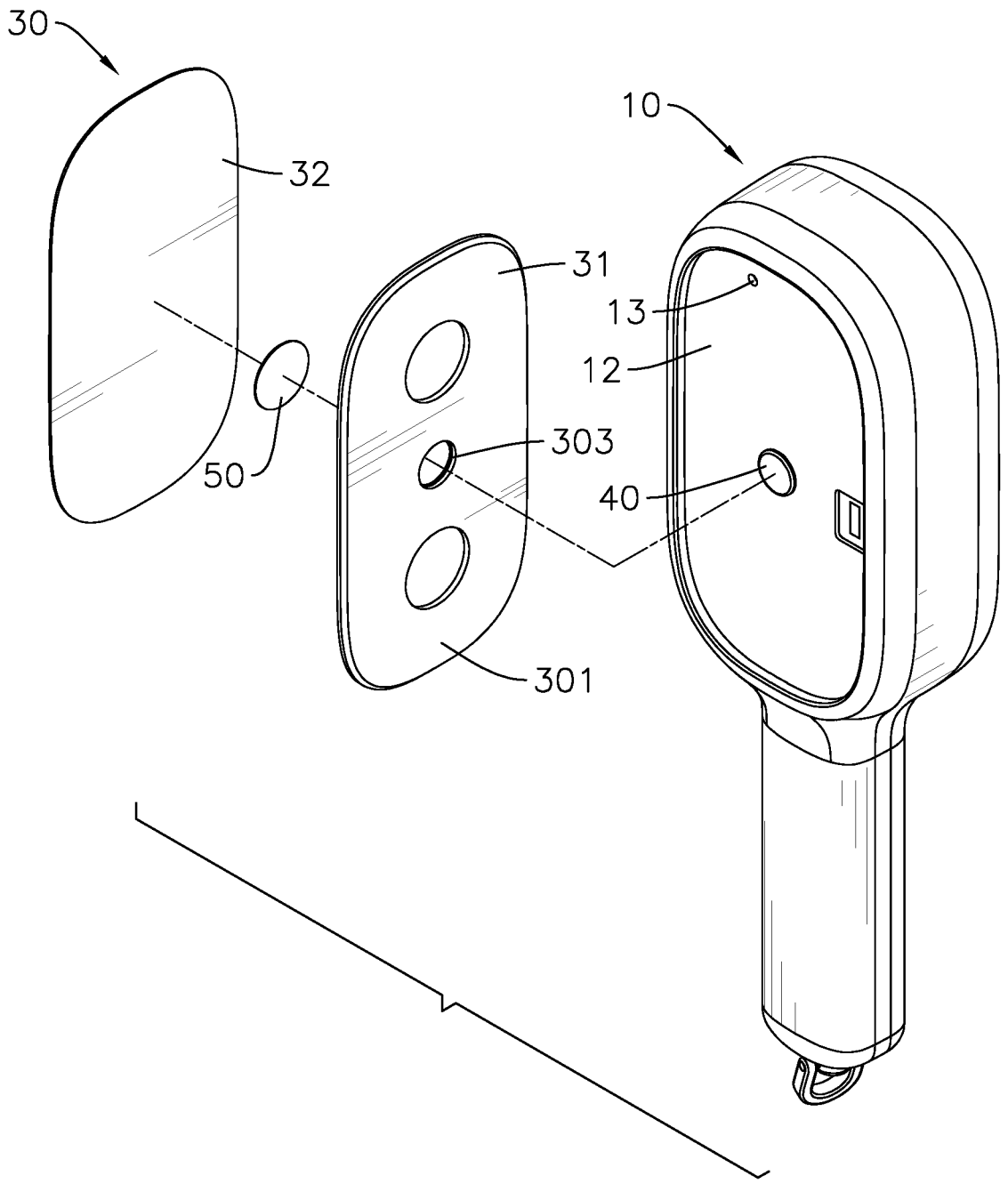
FIG. 4 is an exploded view of the hair comb in FIG. 3.
Figure 6:
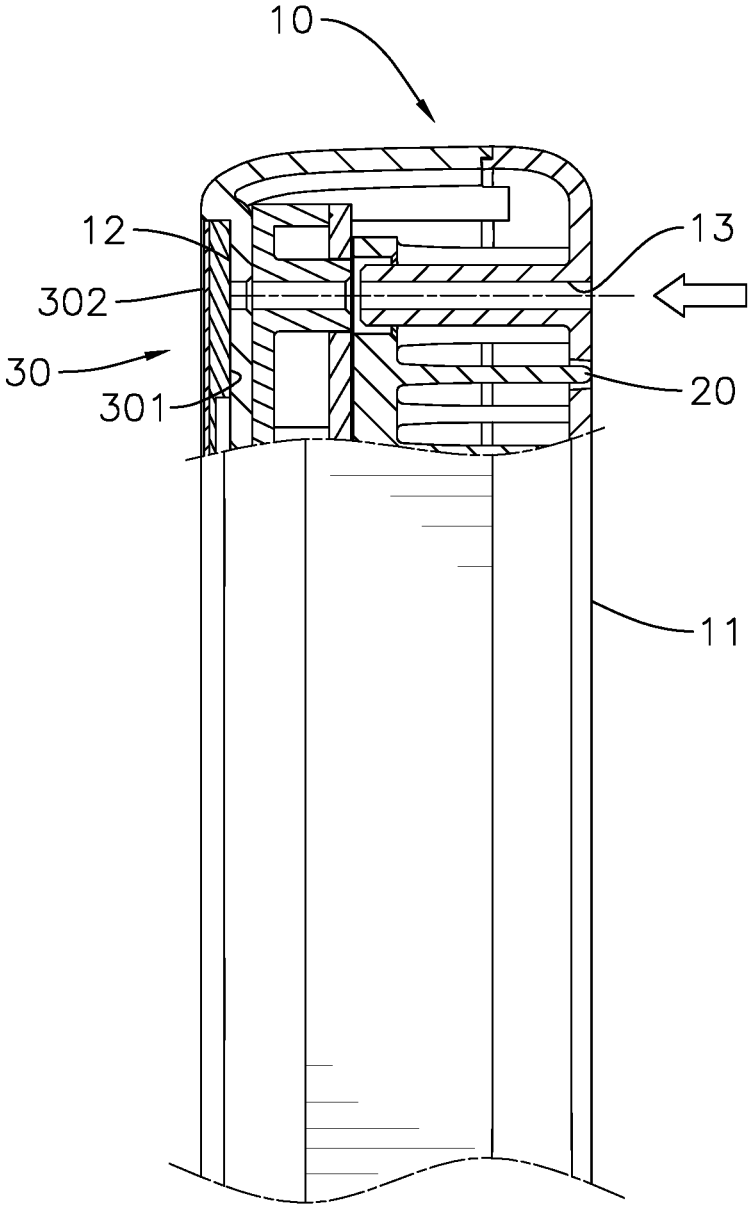
FIG. 6 is another partial sectional view of the hair comb in FIG. 3, showing a passage.

Then please refer to FIG. 2 and FIG. 6. The base assembly 10 comprises a passage 13. The passage 13 is formed from the first surface 11 to the second surface 12. The passage 13 is configured to allow an object (e.g. hairpin) to be inserted into the passage 13 and against the cover unit 30. As a result, the user can insert a tool from the first surface 11 of the base assembly 10, through the passage 13, and out of the second surface 12, then the tool will abut against the cover unit 30. Therefore, the user can apply forces on the tool to separate the cover unit 30 from the base assembly 10.

Figure 7:
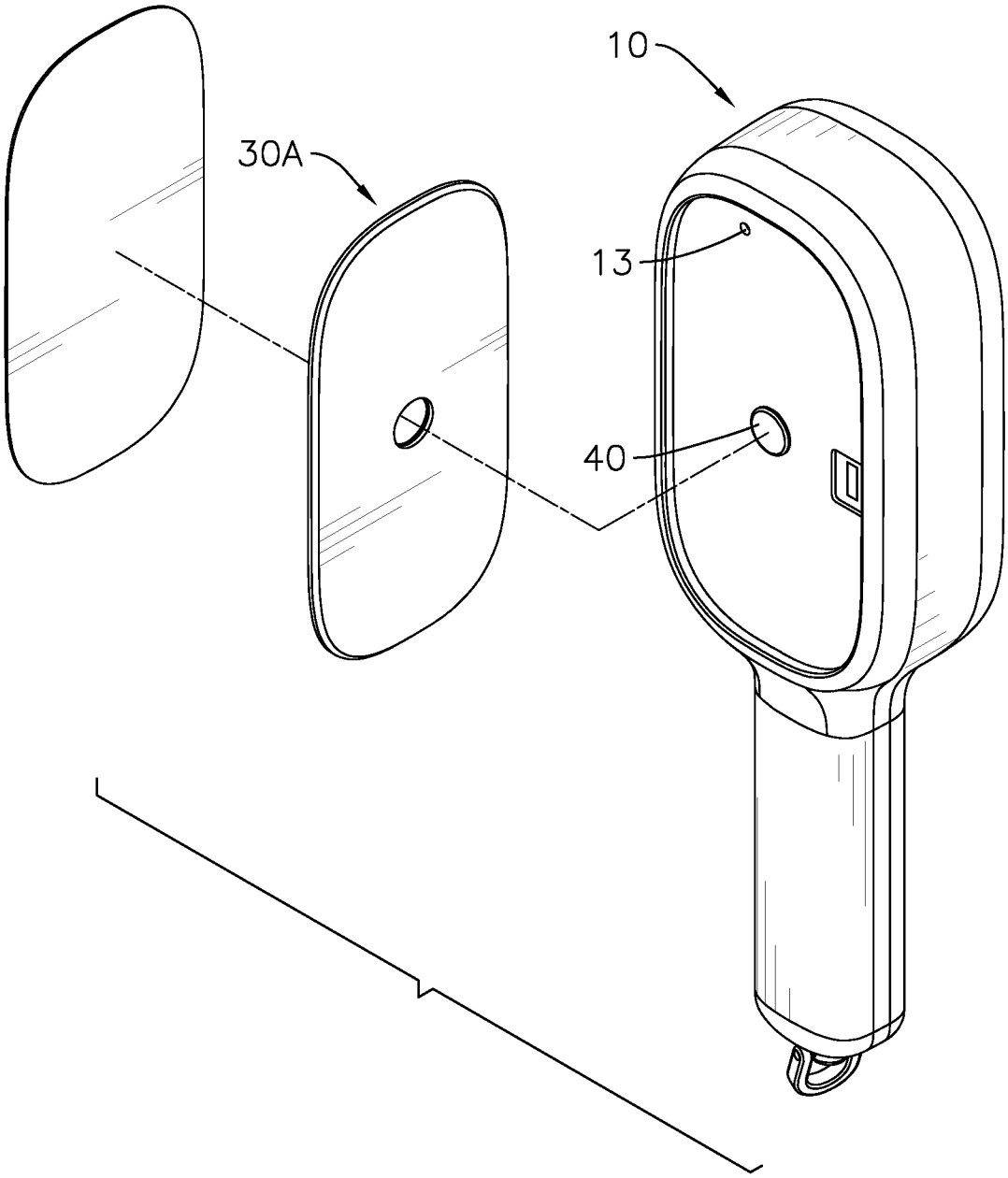
FIG. 7 is a perspective view of a hair comb with a replaceable decorative cover in accordance with a second embodiment of the present invention.

Then please refer to FIG. 7. A second embodiment of a hair comb of the present invention is provided. The second embodiment is similar to the first embodiment, but one difference is that the hair comb of the second embodiment does not include the magnet component mounted on the cover unit as the first embodiment, and instead the cover unit 30A itself is made of a magnet. Therefore, the cover unit 30A can be attracted by the magnet component 40.

Figure 8:
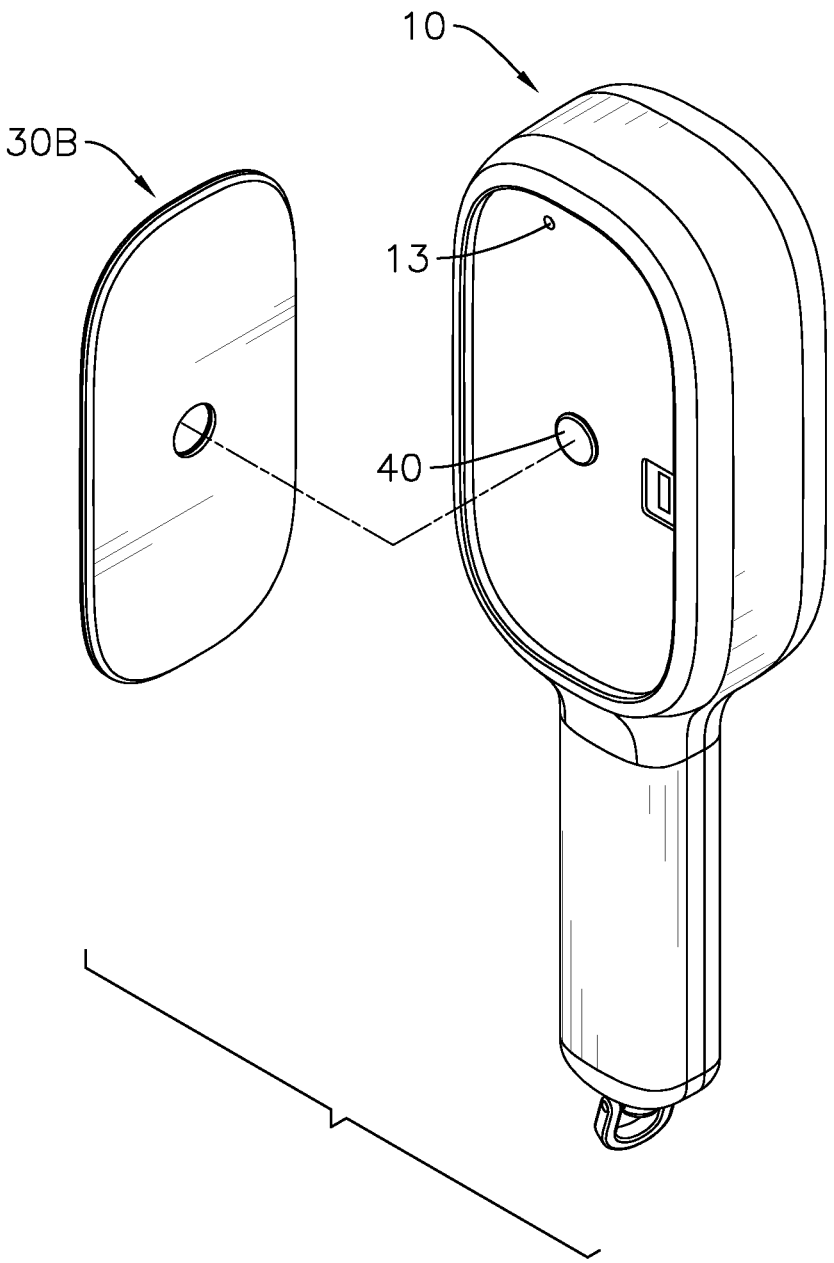
FIG. 8 is a perspective view of a hair comb with a replaceable decorative cover in accordance with a third embodiment of the present invention.

Then please refer to FIG. 8. A third embodiment of a hair comb of the present invention is provided. The third embodiment is similar to the first or the second embodiment but one difference is that the cover unit 30B is an integrated object, which means the foundation plate and the decoration layer are formed integrally and are inseparable.

Figure 9:
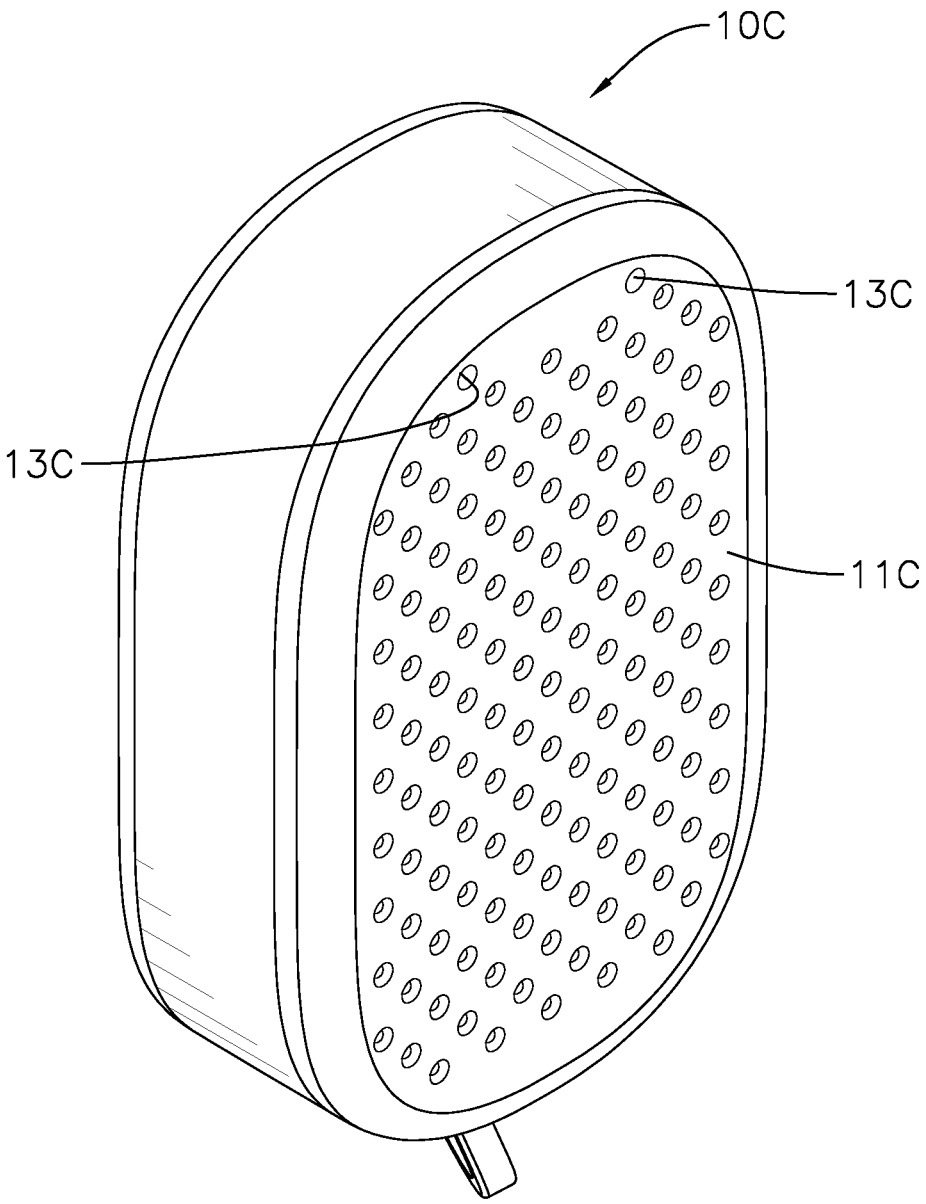
FIG. 9 is a perspective view of a hair comb with a replaceable decorative cover in accordance with a fourth embodiment of the present invention, showing the comb teeth assembly is retractable.
Figure 10:
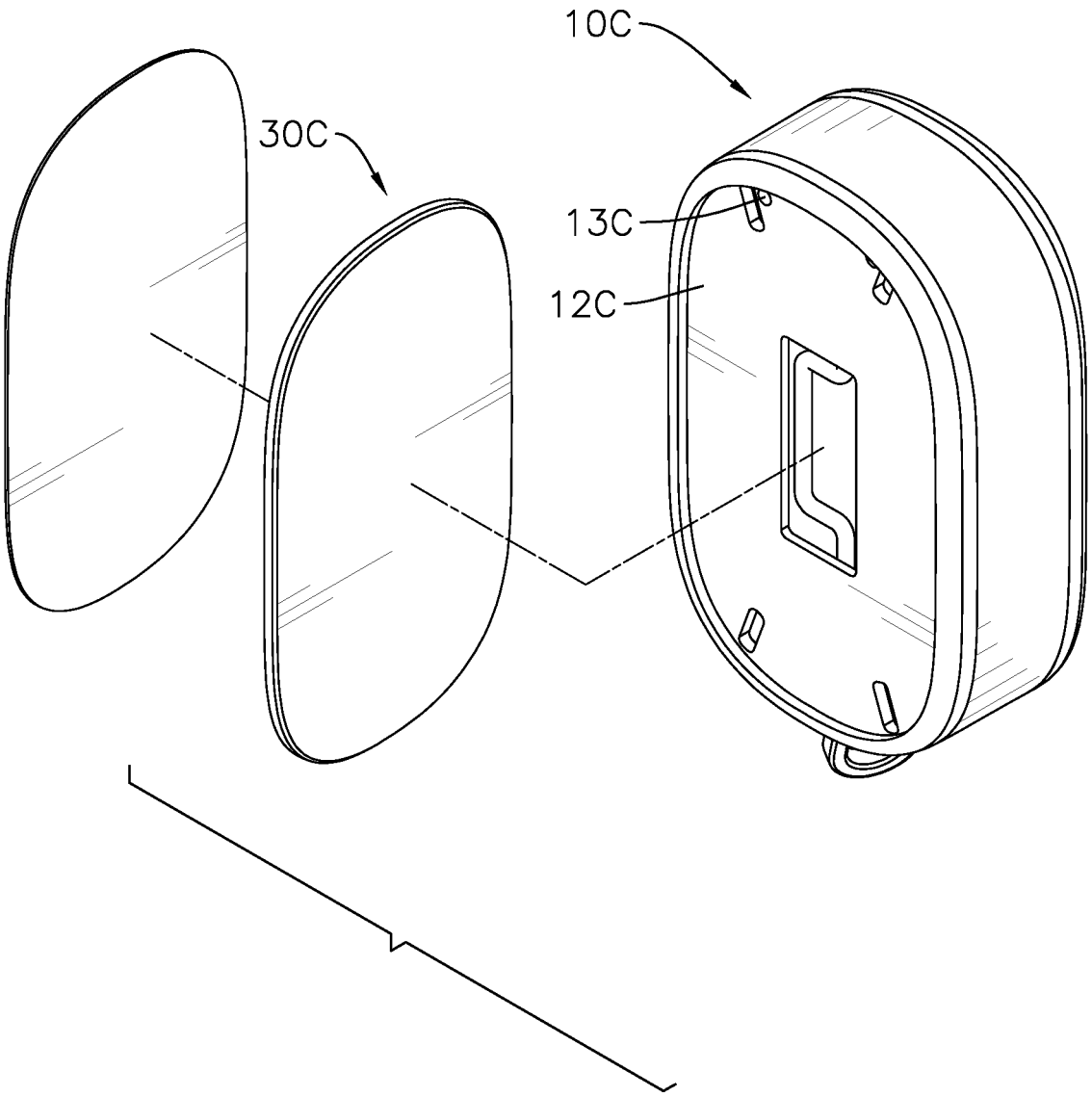
FIG. 10 is an exploded view of the hair comb in FIG. 9.
Figure 11:
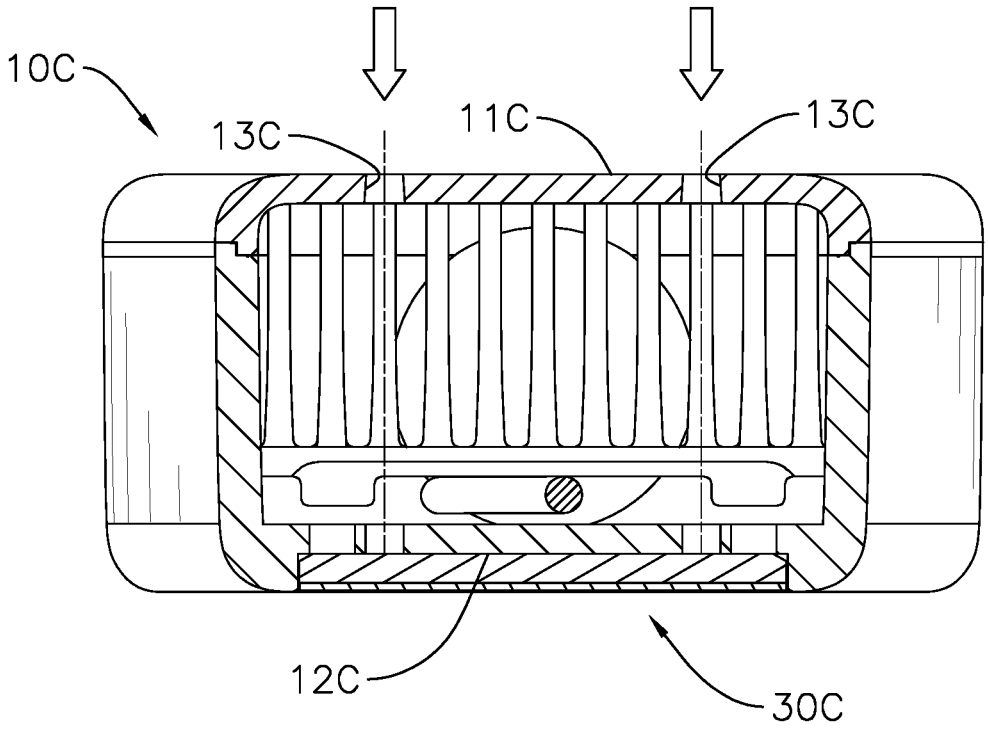
FIG. 11 is a sectional view of the hair comb in FIG. 9, showing passages.

Then please refer to FIG. 9 to FIG. 11. A fourth embodiment of a hair comb of the present invention is provided. The fourth embodiment is similar to any above-mentioned embodiment. One difference is that the hair comb of the fourth embodiment does not comprise a handle. Another difference is the base assembly 10C comprises two passages 13C, but the two passages 13C are also formed from the first surface 11C to the second surface 12C. In this embodiment, the two passages 13C are both close to edges of the first surface 11C and the second surface 12C. Hence the force to move the cover unit 30C may be reduced and thus save much more energy to replace the cover unit 30C.

Figure 12:
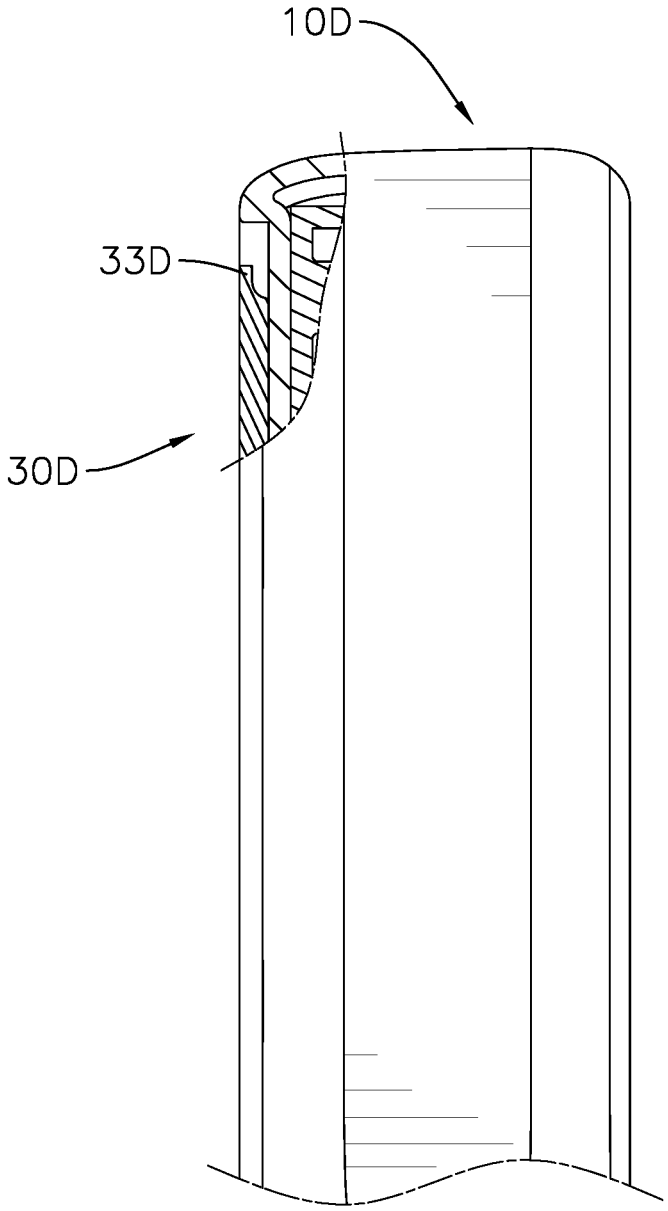
FIG. 12 is a partial sectional view of a hair comb with a replaceable decorative cover in accordance with a fifth embodiment of the present invention, showing a notch portion.

Then please refer to FIG. 12. A fifth embodiment of a hair comb of the present invention is provided. The fifth embodiment is similar to any above-mentioned embodiment. The difference is that the base assembly 10D does not have any passage, but the cover unit 30D has a notch portion 33D formed at an edge of the cover unit 30D. The notch portion 33D is spaced apart from the base assembly 10D. The notch portion 33D facilitates a user's finger to extend into the cover unit 30D and separate the cover unit 30D from the base assembly 10D.

In other words, when the user wants to remove the cover unit 30D, the job can be done by entering a space between the cover unit 30D and the base assembly 10D from the notch portion 33D, then remove the cover unit 30D.

With the aforesaid structures, the present invention makes changing a cover unit of the hair comb easier. For manufacturers, to manufacture hair combs of different styles only requires to manufacture the comb bodies of the same specification (the base assembly and the comb teeth assembly) and various decorative covers with different patterns or figures. Therefore, this not only reduces the cost of manufacture and storage, but also satisfies the consumers' need for various styles. Moreover, this invention provides a hair comb with the easily-replaceable cover unit. Thus it allows consumers to have multiple cover units and replace the cover units by themselves so that the hair comb may be adapted to their outfits.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hair comb comprising:

a base assembly comprising a first surface and a second surface opposite to each other;

a magnet component mounted on the second surface of the base assembly;

a comb teeth assembly mounted on the first surface of the base assembly;

a cover unit detachably mounted on the second surface; the cover unit comprising:

a third surface and a fourth surface opposite to each other; which the third surface facing the second surface, and the fourth surface decorated by patterns or figures; and a magnet-attracted component located at the cover unit and capable of being attracted by the magnet component.

2. The hair comb as claimed in claim 1, wherein the cover unit comprises:

a foundation plate detachably mounted on the second surface, and the third surface formed on the foundation plate;

a decoration layer mounted on the foundation plate, and the fourth surface formed on the decoration layer; the magnet-attracted component mounted between the foundation plate and the decoration layer.

3. The hair comb as claimed in claim 1, wherein the base assembly comprises:

a passage formed from the first surface to the second surface, and configured to allow an object to be inserted into the passage and against the cover unit.

4. The hair comb as claimed in claim 1, wherein the cover unit comprises:

a notch portion formed on an edge of the cover unit and the notch portion spaced apart from the base assembly, thereby facilitating a user's finger to extend into the cover unit and separate the cover unit from the base assembly.

5. A hair comb comprising:

a base assembly comprising a first surface and a second surface opposite to each other;

a magnet component mounted on the second surface of the base assembly;

a comb teeth assembly mounted on the first surface of the base assembly;

a cover unit detachably mounted on the second surface and made from a magnetic material so that the cover unit is capable of being attracted by the magnet component; the cover unit comprising:

a third surface and a fourth surface opposite to each other; the third surface facing the second surface, and the fourth surface decorated by patterns or figures.

6. The hair comb as claimed in claim 5, wherein the cover unit comprises:

a foundation plate detachably mounted on the second surface, and the third surface formed on the foundation plate; the foundation made from a magnetic material;

a decoration layer mounted on the foundation plate, and the fourth surface formed on the decoration layer.

7. The hair comb as claimed in claim 5, wherein the base assembly comprises:

a passage formed from the first surface to the second surface, and configured to allow an object to be inserted into the passage and against the cover unit.

8. The hair comb as claimed in claim 5, wherein the cover unit comprises:

a notch portion formed on an edge of the cover unit and the notch portion spaced apart from the base assembly, thereby facilitating a user's finger to extend into the cover unit and separate the cover unit from the base assembly.

* * * * *